US010215036B2

(12) United States Patent
Garcia-Crespo et al.

(10) Patent No.: US 10,215,036 B2
(45) Date of Patent: Feb. 26, 2019

(54) BLADE ATTACHMENT ASSEMBLY

(71) Applicant: General Electric Company, Schenectady, NY (US)

(72) Inventors: Andres Jose Garcia-Crespo, Greenville, SC (US); John McConnell Delvaux, Fountain Inn, SC (US); Diane Patricia Miller, Columbia, SC (US)

(73) Assignee: General Electric Company, Schenectady, NY (US)

( * ) Notice: Subject to any disclaimer, the term of this patent is extended or adjusted under 35 U.S.C. 154(b) by 393 days.

(21) Appl. No.: 15/086,539

(22) Filed: Mar. 31, 2016

(65) Prior Publication Data

US 2016/0208625 A1 Jul. 21, 2016

Related U.S. Application Data

(63) Continuation of application No. 13/494,261, filed on Jun. 12, 2012, now Pat. No. 9,328,622.

(51) Int. Cl.
*F01D 5/30* (2006.01)
*F01D 5/14* (2006.01)

(52) U.S. Cl.
CPC ..... *F01D 5/3015* (2013.01); *F01D 5/303* (2013.01); *F01D 5/3007* (2013.01); (Continued)

(58) Field of Classification Search
CPC . F01D 5/3015; F01D 5/3084; F05D 2260/941
See application file for complete search history.

(56) References Cited

U.S. PATENT DOCUMENTS 3,137,478 A 6/1964 Farrell
4,084,922 A 4/1978 Glenn
(Continued)

FOREIGN PATENT DOCUMENTS

CN 101818659 A 9/2010
CN 101892911 A 11/2010
(Continued)

OTHER PUBLICATIONS

Decision to Grant issued in connection with corresponding RU Application No. 2013116552 dated Feb. 13, 2017.
(Continued)

*Primary Examiner* — Ninh H. Nguyen
(74) *Attorney, Agent, or Firm* — Ernest G. Cusick; Hoffman Warnick LLC

(57) ABSTRACT

An assembly and method for affixing a turbomachine rotor blade to a rotor wheel are disclosed. In an embodiment, an adaptor member is provided disposed between the blade and the rotor wheel, the adaptor member including an adaptor attachment slot that is complementary to the blade attachment member, and an adaptor attachment member that is complementary to the rotor wheel attachment slot. A coverplate is provided, having a coverplate attachment member that is complementary to the rotor wheel attachment slot, and a hook for engaging the adaptor member. When assembled, the coverplate member matingly engages with the adaptor member, and retains the blade in the adaptor member, and the assembly in the rotor wheel.

19 Claims, 5 Drawing Sheets

(52) U.S. Cl.
CPC ..... *F01D 5/3084* (2013.01); *F01D 5/147* (2013.01); *F05D 2300/6033* (2013.01)

(56) References Cited

U.S. PATENT DOCUMENTS

| | | | | |
|---|---|---|---|---|
| 4,093,399 | A | 6/1978 | Glenn | |
| 4,094,615 | A | 6/1978 | Glenn | |
| 4,111,603 | A | 9/1978 | Stahl | |
| 4,142,836 | A | 3/1979 | Glenn | |
| 4,480,959 | A | 11/1984 | Bourguignon et al. | |
| 5,222,865 | A | 6/1993 | Corsmeier | |
| 5,372,481 | A | 12/1994 | Boyd | |
| 5,405,245 | A | 4/1995 | Cornelius | |
| 5,431,541 | A | 7/1995 | Shaffer | |
| 5,435,693 | A | 7/1995 | Shaffer | |
| 5,580,219 | A | 12/1996 | Frey et al. | |
| 5,743,716 | A | 4/1998 | Hattori et al. | |
| 6,190,131 | B1 | 2/2001 | Deallenbach | |
| 7,094,021 | B2 | 8/2006 | Haubert | |
| 8,277,191 | B2 | 10/2012 | Ammann | |
| 8,602,737 | B2 | 12/2013 | Garcia-Crespo | |
| 8,696,320 | B2 | 4/2014 | Harris, Jr. et al. | |
| 8,740,573 | B2 | 6/2014 | Delvaux et al. | |
| 9,151,169 | B2 * | 10/2015 | Piersall | F01D 5/3015 |
| 2010/0172760 | A1 | 7/2010 | Ammann | |
| 2014/0112794 | A1 | 4/2014 | Garcia-Crespo et al. | |

FOREIGN PATENT DOCUMENTS

| | | | |
|---|---|---|---|
| CN | 102296993 | A | 12/2011 |
| FR | 2 587 060 | A1 | 3/1987 |
| GB | 740757 | A | 11/1955 |
| JP | S39-026222 | B | 11/1964 |
| JP | S59-226202A | A | 12/1984 |
| JP | S62-041902 | A | 2/1987 |
| JP | H06-058102 | A | 3/1994 |
| JP | 2010-159748 | A | 7/2010 |
| SU | 126501 | A1 | 11/1959 |

OTHER PUBLICATIONS

Search Report issued in connection with corresponding JP Application No. 2013-081699 dated Feb. 20, 2017.

Notification of Reasons for Refusal issued in connection with corresponding JP Application No. 2013-081699 dated Feb. 28, 2017.

Decision to Grant issued in connection with corresponding JP Application No. 2013-081699 dated Jun. 20, 2017.

EP Search Report dated Apr. 22, 2015 in relation to corresponding EP application 13163609.4.

Third Office Action issued in connection with corresponding CN Application No. 201310126564.5 dated Aug. 22, 2016.

* cited by examiner

BLADE ATTACHMENT ASSEMBLY

CROSS-REFERENCE TO RELATED APPLICATIONS

This application is a continuation application of U.S. application Ser. No. 13/494,261, filed Jun. 12, 2012, currently pending. The application identified above is incorporated herein by reference in its entirety for all that it contains in order to provide continuity of disclosure.

GOVERNMENT LICENSE RIGHTS

This invention was made with Government support under contract number DE-FC26-05NT42643 awarded by the Department of Energy. The government has certain rights in the invention.

BACKGROUND OF THE INVENTION

The invention relates generally to a turbomachine such as a gas turbine, and more particularly, to an assembly and method for attaching a rotating turbine blade to a rotor wheel.

Rotating blades in turbomachines such as gas turbines are typically subjected to extremely high temperatures during operation. In the past, blades and other features have been made of metals such as high temperature steels and nickel alloys. These metal blades have required the addition of cooling passages in order to prevent the blades from melting and deforming during operation. Alternatives to the engineering difficulties presented by the cooling requirements of metal blades have included the use of ceramic coatings on metal blades, and the use of entirely non-metal blades made of, e.g., ceramic. Ceramic blades provide additional advantages, such as lighter weights which result in greater efficiency in the turbomachine.

Conventional joints between metal blades and rotor wheels have used a fir tree attachment or root design, having multiple tangs or surfaces. For example, a three tang design may be used. In contrast, ceramic blades have typically used a dovetail design having a single tang, an arrangement less prone to wear and breakage in ceramic blades due to thermal mismatch between the metal wheel and the ceramic blade. Despite the advantages of equipping turbomachines with non-metallic blades, the non-complementary shapes of non-metallic blade dovetails and rotor wheels designed to accept metal blades having a fir tree attachment member present a challenge in doing so.

BRIEF DESCRIPTION OF THE INVENTION

A first aspect of the disclosure provides an assembly for affixing a blade having a blade attachment member to a rotor wheel having a rotor wheel attachment slot. The assembly includes an adaptor member disposed between the blade and the rotor wheel, having an adaptor attachment slot that is complementary to the blade attachment member, and an adaptor attachment member that is complementary to the rotor wheel attachment slot disposed on an opposite end of the adaptor member from the adaptor attachment slot. The assembly further includes a coverplate member, the coverplate member including a coverplate attachment member that is complementary to the rotor wheel attachment slot, and a hook disposed on a radially inward end of the coverplate attachment member for engaging the adaptor member, wherein the hook axially retains the adaptor member relative to the coverplate member. When assembled, the blade attachment member is axially inserted into the adaptor attachment slot, the coverplate member matingly engages a leading edge face of the adaptor member, and the assembled adaptor attachment member and coverplate attachment member are axially inserted into the rotor wheel attachment slot.

A second aspect of the disclosure provides a turbomachine comprising a rotor rotatably mounted within a stator, the rotor including a shaft and at least one rotor wheel mounted on the shaft, each of the at least one rotor wheels including a rotor wheel attachment slot, a blade having a blade attachment member that is not complementary to the rotor wheel attachment slot; and an assembly for affixing the blade attachment member to the rotor wheel attachment slot. The assembly includes an adaptor member disposed between the blade and the rotor wheel, having an adaptor attachment slot that is complementary to the blade attachment member, and an adaptor attachment member that is complementary to the rotor wheel attachment slot disposed on an opposite end of the adaptor member from the adaptor attachment slot. The assembly further includes a coverplate member, the coverplate member including a coverplate attachment member that is complementary to the rotor wheel attachment slot, and a hook disposed on a radially inward end of the coverplate attachment member for engaging the adaptor member, wherein the hook axially retains the adaptor member relative to the coverplate member. When assembled, the blade attachment member is axially inserted into the adaptor attachment slot, the coverplate member matingly engages a leading edge face of the adaptor member, and the assembled adaptor attachment member and coverplate attachment member are axially inserted into the rotor wheel attachment slot.

A third aspect of the disclosure provides a method for assembling a blade having a blade attachment member to a rotor wheel having a rotor wheel attachment slot. The method includes providing an adaptor member, the adaptor member including an adaptor attachment slot that is complementary to the blade attachment member, and an adaptor attachment member that is complementary to the rotor wheel attachment slot; and providing a coverplate member, the coverplate member including a coverplate attachment member that is complementary to the rotor wheel attachment slot, and a hook disposed on a radially inward end of the coverplate attachment member. The blade attachment member is axially inserted into the adaptor attachment slot; and the coverplate member is placed on a leading edge face of the adaptor member such that the leading edge face of the adaptor member and the trailing edge face of the coverplate member matingly engage. With the coverplate member, the blade attachment member is axially maintained in the adaptor attachment slot. The adaptor attachment member and the coverplate attachment member are then axially inserted into the rotor wheel attachment slot.

These and other aspects, advantages and salient features of the invention will become apparent from the following detailed description, which, when taken in conjunction with the annexed drawings, where like parts are designated by like reference characters throughout the drawings, disclose embodiments of the invention.

Figure 1:
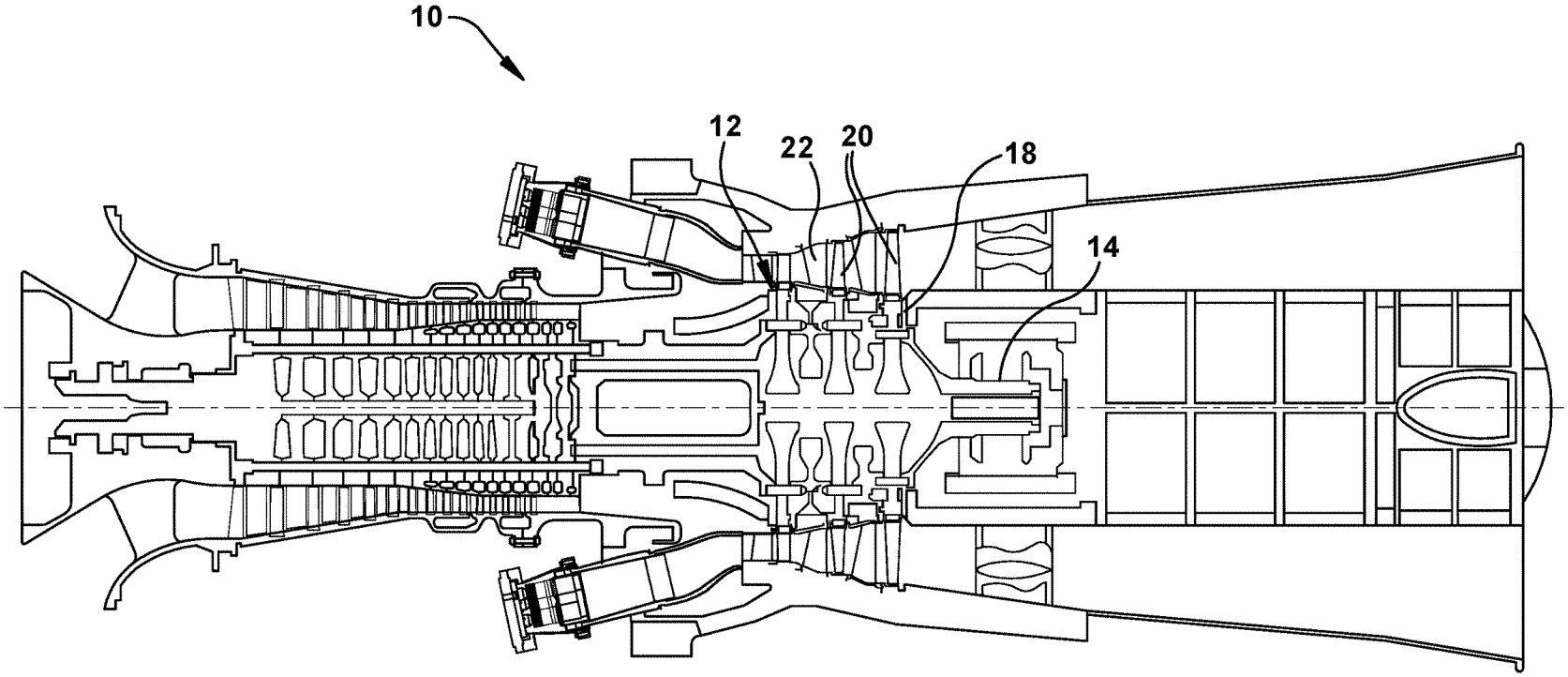
FIG. 1 shows a cross sectional illustration of a gas turbine.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

At least one embodiment of the present invention is described below in reference to its application in connection with and operation of a turbomachine in the form of a gas turbine. Further, at least one embodiment of the present invention is described below in reference to a nominal size and including a set of nominal dimensions. However, it should be apparent to those skilled in the art and guided by the teachings herein that embodiments of the present invention are likewise applicable to any suitable turbine and/or engine, such as, e.g., a steam turbine. Further, it should be apparent to those skilled in the art and guided by the teachings herein that embodiments of the present invention are likewise applicable to various scales of the nominal size and/or nominal dimensions.

Referring to the drawings, FIG. 1 shows a cross sectional illustration of a gas turbine 10. The turbine 10 includes a rotor 12 that includes a shaft 14 and a plurality of axially spaced rotor wheels 18. In some embodiments, each rotor wheel 18 may be made of metal such as, for example, steel. A plurality of rotating blades 20 are mechanically coupled to each rotor wheel 18. More specifically, blades 20 are arranged in rows that extend circumferentially around each rotor wheel 18. A plurality of stationary vanes 22 extend circumferentially around shaft 14 and are axially positioned between adjacent rows of blades 20.

During operation, air at atmospheric pressure is compressed by a compressor and delivered to a combustion stage. In the combustion stage, the air leaving the compressor is heated by adding fuel to the air and burning the resulting air/fuel mixture. The gas flow resulting from combustion of fuel in the combustion stage then expands through turbine 10, delivering some of its energy to drive turbine 10 and produce mechanical power. To produce driving torque, turbine 10 consists of one or more stages. Each stage includes a row of vanes 22 and a row of rotating blades 20 mounted on a rotor wheel 18. Vanes 22 direct incoming gas from the combustion stage onto blades 20. This drives rotation of the rotor wheels 18, and as a result, shaft 14, producing mechanical power.

FIGS. 2-7 show various aspects of an assembly 100 for retaining blades 20 in their circumferential arrangement about rotor wheels 18.

Figure 2:
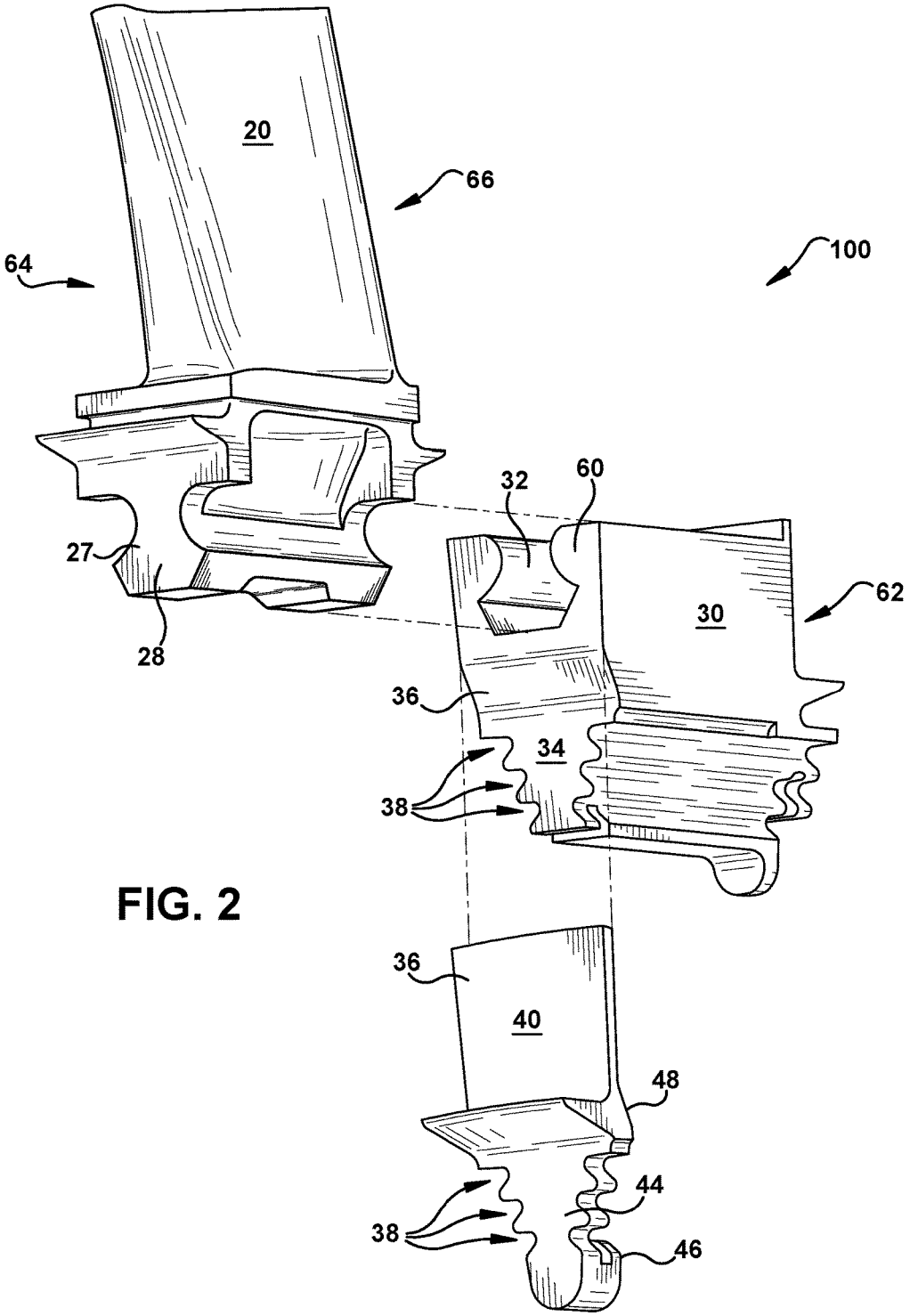
FIG. 2 shows an exploded perspective view of an assembly for affixing a blade to a rotor wheel in accordance with an embodiment of the invention.
Figure 6:
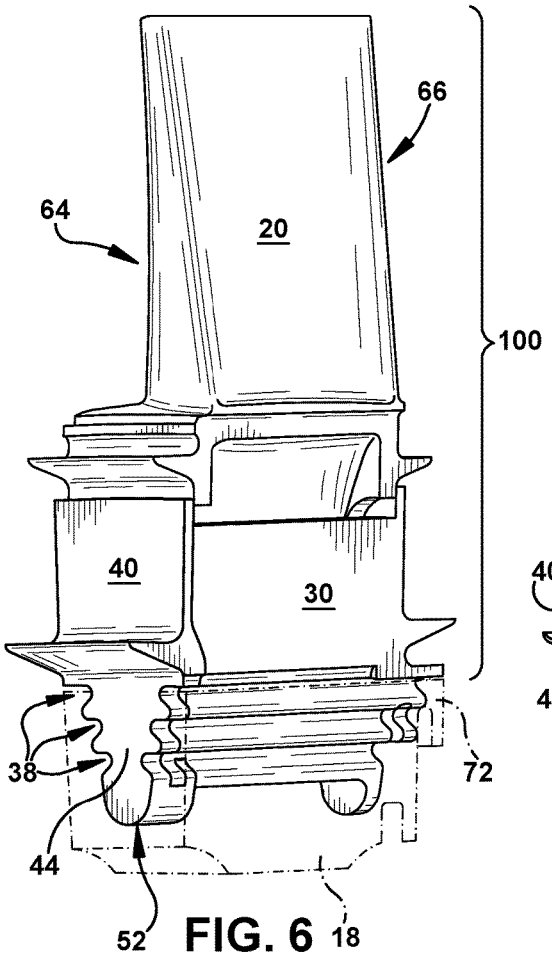
FIG. 6 shows a perspective view of a blade affixed to a rotor wheel in accordance with an embodiment of the invention.
Figure 7:
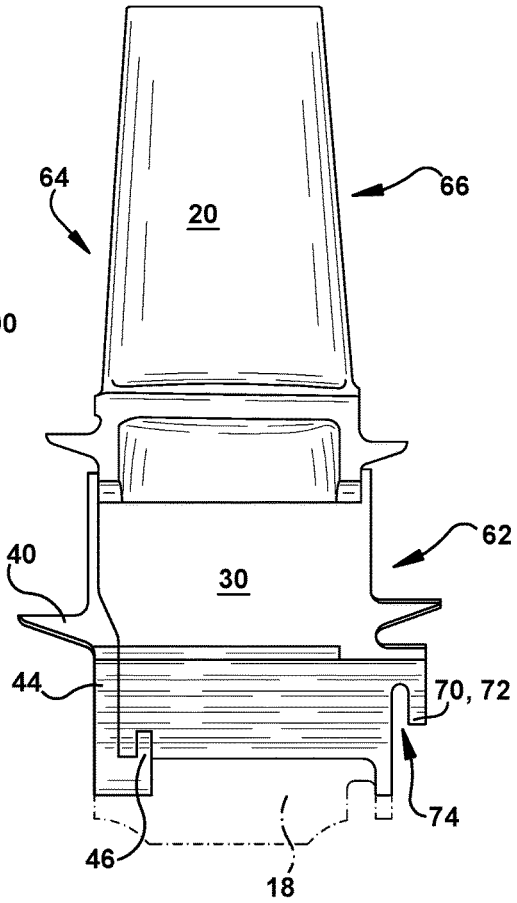
FIG. 7 shows a side view of a blade affixed to a rotor wheel in accordance with an embodiment of the invention.

As shown in FIG. 2, each blade 20 includes a male blade attachment member 28 for affixing the blade 20 to a rotor wheel 18 (FIGS. 1 and 6-7). As shown in FIG. 6, each rotor wheel 18 also includes a female rotor wheel attachment slot 52 into which blade attachment member 28 can be inserted. In some embodiments, blade attachment member 28 may be complementary with rotor wheel attachment slot 52. In such an embodiment, blade attachment member 28 and rotor wheel attachment slot 52 are complementary in that blade attachment member 28 has the same number of tangs or surfaces as a female rotor wheel attachment slot 52 into which it is inserted, and blade attachment member 28 matingly engages with rotor wheel attachment slot 52 with a close fit between opposing surfaces. For example, blade attachment member 28 and rotor wheel attachment slot 52 may respectively include a male single tang dovetail 27, and a complementary, mating female single tang dovetail slot. In such an example, blade attachment member 28 is retained securely in a complementary rotor wheel attachment slot 52 by this close fit between blade attachment member 28 and rotor wheel attachment slot 52.

In other embodiments, such as those shown in FIGS. 2-7, blade attachment member 28 and rotor wheel attachment slot 52 may be non-complementary. As shown in FIG. 2, blade attachment member 28 may have a male dovetail shape having a single tang 27. Rotor wheel attachment slot 52 may have any of a variety of non-complementary (relative to blade attachment member 28) geometries including but not limited to a fir tree geometry that includes more than one tang 38, e.g., two tangs (not shown) or three tangs 38 (FIG. 2). In other embodiments, rotor wheel attachment slot 52 may have a T-slot configuration.

Even if single tang 27 blade attachment member 28 can be inserted into multi-tang 38 rotor wheel attachment slot 52, i.e., even if single tang 27 does not exceed any dimension of rotor wheel attachment slot 52, blade attachment member 28 would not be securely retained in rotor wheel attachment slot 52 because of the poor fit between non-complementary shapes.

Additionally, blade attachment member 28 and rotor wheel 18 may or may not be made of the same or similar material. Blade 20, including blade attachment member 28, may be made of either a metallic material or a non-metallic material. In embodiments in which blade 20 is non-metallic, it may be, for example, metal coated with ceramic, ceramic, or ceramic matrix composite (CMC). Such non-metallic embodiments may be employed with single tang 27 dovetail attachment members 28. Rotor wheel 18 may be made of a metal such as, e.g., steel or a metal alloy.

In order to affix a blade 20 to rotor wheel 18, particularly where blade attachment member 28 and rotor wheel attachment slot 52 are non-complementary, an adaptor member 30 may be used. Referring back to FIG. 2, adaptor member 30 includes a female adaptor attachment slot 32 that has a shape that is complementary to the shape of blade attachment member 28 on blade 20. Specifically, adaptor attachment slot 32 may have a shape complementary to the single-tang 27 dovetail of blade attachment member 28. Adaptor member 30 may also include a male adaptor attachment member 34 on an opposite end of adaptor member 30 from adaptor attachment slot 32. The geometry of adaptor attachment member 34 may have a shape and geometry that is complementary to the shape and geometry of rotor wheel attachment slot 52 (FIG. 6). Specifically, adaptor attachment member 34 may have a multi-tang 38 fir tree shape that is shaped and dimensioned to be received in rotor wheel attachment slot 52. In various embodiments, adaptor attachment member 34 may have a single tang dovetail configuration, a two-tang fir tree configuration, a three-tang fir tree configuration, or a T-slot configuration. Rotor wheel attachment slot 52 may be shaped and dimensioned to receive adaptor attachment member 34. The particular shapes of the complementary adaptor attachment member and slot pairs illustrated herein are not intended to be limiting. Each of adaptor attachment slot 32 and adaptor attachment member 34 run substantially axially lengthwise along adaptor member 30.

Figure 3:
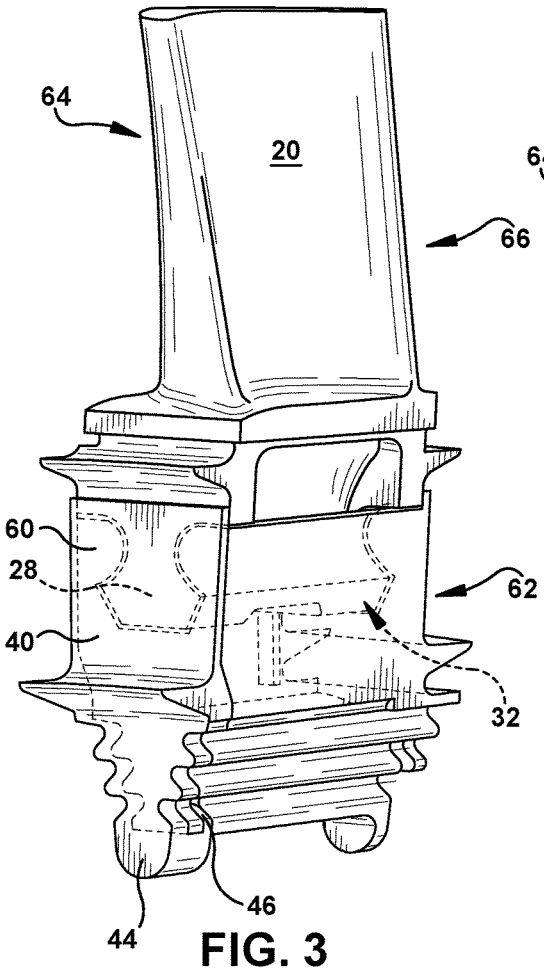
FIG. 3 shows a perspective view of an assembly for affixing a blade to a rotor wheel in accordance with an embodiment of the invention.
Figure 4:
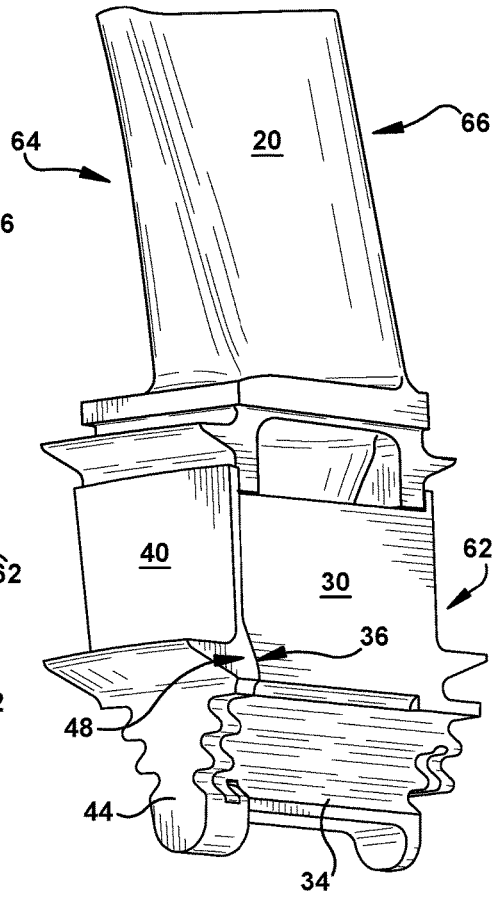
FIG. 4 shows a perspective view of an assembly for affixing a blade to a rotor wheel in accordance with an embodiment of the invention.

Adaptor member 30 includes a first face 60 and a second face 62 disposed on axial ends of adaptor member 30. When adaptor member 30 is assembled to blade 20 as shown in FIGS. 3-5, adaptor member 30 may be oriented with respect to blade 20 such that first face 60 substantially aligns with leading edge 64 of blade 20, and second face 62 substantially aligns with trailing edge 66 of blade 20.

Adaptor member 30 may further include a chamfer 36 on the first face 60. Chamfer 36 provides an angle along first face 60 between the adaptor attachment member 34 and the adaptor attachment slot 32, such that the axial length of adaptor attachment member 34 is shorter than the axial length of the radially outward portion of adaptor member 30 that forms adaptor attachment slot 32. Put another way, adaptor attachment slot 32 has a greater axial length than, and extends beyond adaptor attachment member 34 on the axial end of adaptor member 30 nearer to first face 60, as shown in FIG. 5.

Figure 5:
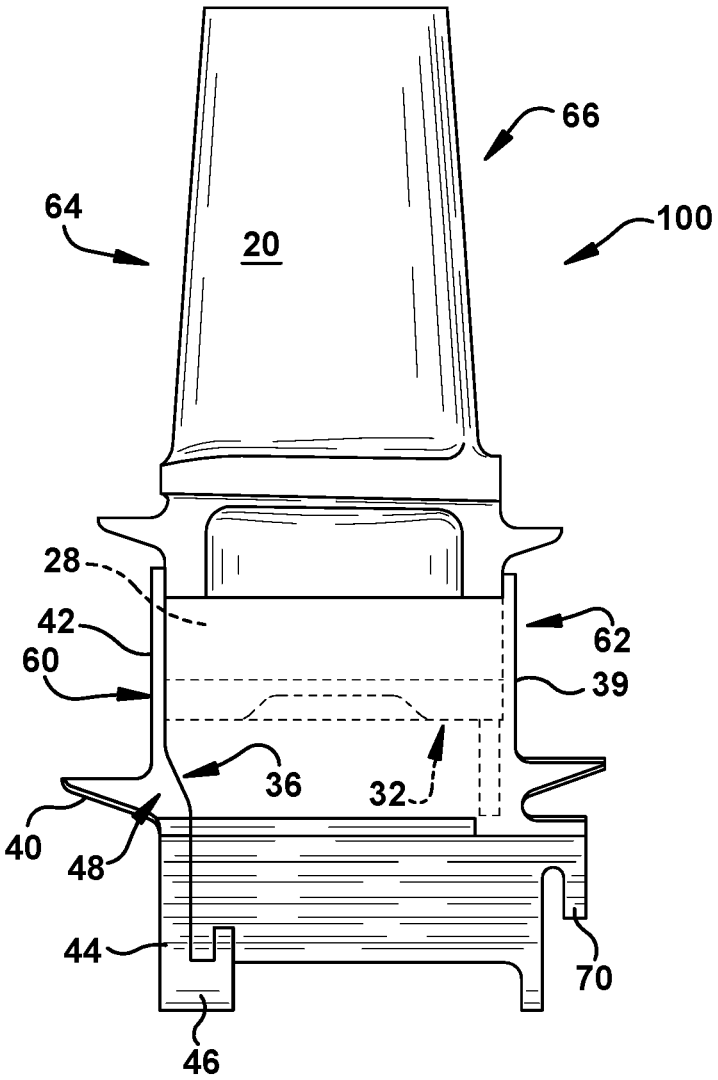
FIG. 5 shows a side view of an assembly for affixing a blade to a rotor wheel in accordance with an embodiment of the invention.

With continued reference to FIG. 5, on a second face 62 of adaptor member 30, adaptor member 30 includes a solid face or wall 39 which prevents blade attachment member 28 from entering adaptor attachment slot 32 on a first face 60 side and exiting out the second face 62 side. As shown in FIGS. 3-7, blade attachment member 28 is axially inserted into the adaptor attachment slot 32 from the side of first face 60, which has an opening for adaptor attachment slot 32. Blade attachment member 28 occupies substantially the full axial length of adaptor attachment slot 32 without extending beyond it. As discussed further herein below, adaptor member 30 may also include an axial retention device 70 (FIG. 5) disposed on second face 62 and extending axially outward from second face 62 and radially inward, forming a hook-shaped member.

Assembly 100 may further include coverplate member 40, shown in FIG. 2, which may be made of metal, and may more specifically be a nickel based superalloy, titanium aluminide (TiAl), or another suitable alloy in various embodiments. Coverplate member 40 includes a coverplate attachment member 44 that has a shape that is substantially complementary to the shape of rotor wheel attachment slot 52 (shown in FIG. 6), and further, substantially shares a geometry with adaptor attachment member 34. A panel member 42 (FIG. 5) extends radially outward from coverplate attachment member 44, and is shaped and dimensioned such that when assembled, it substantially covers first face 60 and occludes the opening in first face 60 leading into adaptor attachment slot 32. Coverplate member 40 additionally includes, at the radially inward end of coverplate attachment member 44, a hook 46 which hooks inward toward adaptor member 30 when assembled as in FIGS. 3-5.

Referring back to FIG. 2, coverplate member 40 further includes a chamfer 48 on an inner face of the coverplate member 40, between coverplate attachment member 44 and panel member 42. When assembly 100 is assembled, as shown in FIGS. 4-5, chamfer 48 on coverplate member 40 matingly engages with chamfer 36 on the first face 60 of adaptor member 30, i.e., chamfer 48 cants at an angle opposite that of chamfer 36 on adaptor member 30.

When assembled, panel member 42 covers first face 60 of adaptor member 30 (FIGS. 3-5) and maintains the blade attachment member 28 axially within the adaptor attachment slot 32. As best shown in FIG. 5, blade attachment member 28 is retained in adaptor attachment slot 32 between wall 39 and panel member 42, and coverplate member 40 matingly engages with adaptor member 30. Further, hook 46 engages the adaptor member 30, fixing the axial position of coverplate member 40 relative to adaptor member 30.

As shown in FIGS. 6-7, assembly 100 is affixed to rotor wheel 18 by axially inserting adaptor attachment member 34 and coverplate attachment member 44 into rotor wheel attachment slot 52. Assembly 100 is axially retained within rotor wheel attachment slot 52 by axial retention devices 70, 72 on adaptor member 30 and rotor wheel 18 respectively. Axial retention device 70 is best seen in FIG. 5; axial retention device 72 is best seen in FIG. 6. As noted above, axial retention device 70 is disposed on a second face 62 of adaptor member 30 and forms a hook shape extending axially outward and radially inward. Axial retention device 72 on rotor wheel 18 is similarly shaped, and located near the outer circumference of rotor wheel 18. When assembled, as shown in FIG. 7, axial retention devices 70, 72 align and form a space 74 between the axial retention devices 70, 72 and rotor wheel 18 for placement of an axial retention cable (not shown). In this manner, adaptor member 30 and coverplate member 40 allow for blade 20 to be affixed to rotor wheel 18.

Coverplate member 40 provides a seal over assembly 100 and rotor wheel 18, preventing leakage of hot gas into rotor wheel slot 52, among other small spaces. This seal facilitates the use of rotor wheels 18 and blades 20 made of different materials having different coefficients of thermal expansion while minimizing risk of breakage or damage due to exposure to hot gases. The seal may also broaden the range of potential materials from which rotor wheel 18 can be made, as the specifically shaped rotor wheel attachment slots 52 will not be subjected to hot gases from the turbine environment.

A method is also provided for attaching a blade 20 to rotor wheel 18. Blade 20 includes a blade attachment member 28, and rotor wheel 18 includes a rotor wheel attachment slot 52, which may have geometries that are non-complementary with one another. As shown in FIG. 2, initially, a blade 20 and an adaptor member 30 are provided as described previously. Adaptor member 30 includes an adaptor attachment slot 32 that has a geometry complementary to that of the blade attachment member 28, such that blade attachment member 28 is shaped and dimensioned to be received in adapter attachment slot 32, and an adaptor attachment member 34 that is complementary to the rotor wheel attachment slot 52 such that adapter attachment member 34 is shaped and dimensioned to be received in rotor wheel attachment slot 52. A coverplate member 40 is also provided, having a coverplate attachment member 44 that has a geometry that is complementary to that of rotor wheel attachment slot 52. An inward-facing hook 46 is disposed on a radially inward end of the coverplate attachment member 44.

As shown in FIGS. 3-5, blade attachment member 28 is axially inserted into the adaptor attachment slot 32 such that it fills the adaptor attachment slot 32, and abuts wall 39.

Coverplate member 40 is then placed over a first face 60 of adaptor member 30 such that first face 60 and matingly engages with coverplate member 40. A portion of coverplate member 40, which may particularly be panel member 42, covers an open end of adaptor attachment slot 32 on a first face 60 of adaptor member 30, thus preventing blade attachment member 28 from sliding out. Additionally, coverplate member 40 provides a seal over assembly 100, preventing hot gases from the operating environment from entering small spaces in the assembly.

Assembly 100, thus put together, may then be axially inserted into rotor wheel attachment slot 52 as shown in FIGS. 6-7, such that the complementary rotor wheel attachment slot 52 and adaptor attachment member 34/coverplate attachment member 44 engage one another. This locks blade 20 in place with respect to rotor wheel 18. The assembly may then be secured to rotor wheel 18 by a cable disposed between axial retention devices 70, 72 and rotor wheel 18.

The foregoing assembly 100 and method of assembling a blade 20 to a rotor wheel 18 allows for retrofittability of, e.g., blades having a single-tang 27 dovetail shape attachment member into a rotor wheel designed to accept multi-tang 38 fir tree geometry blade roots. This allows for retrofitting existing turbines 10 with, e.g., non-metal blades or metal alloy blades having an attachment geometry that differs from that of the rotor wheel.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly for affixing a blade having a blade attachment member to a rotor wheel having a rotor wheel attachment slot, the assembly comprising:

an adaptor member disposed between the blade and the rotor wheel, the adaptor member including:

a first face;

a second face positioned opposite the first face;

an adaptor attachment slot formed through the first face and extending toward the second face, the adaptor attachment slot complementary to the blade attachment member;

a wall formed on the second face such that the adaptor attachment slot is open on the first face only; and an adaptor attachment member that is complementary to the rotor wheel attachment slot; and a coverplate member, the coverplate member configured to engage the adaptor member and including:

a coverplate attachment member that is complementary to the rotor wheel attachment slot; and a hook-shaped feature disposed on a radially inward end of the coverplate attachment member for engaging the adaptor member, wherein the hook-shaped feature axially retains the adaptor member relative to the coverplate member, wherein the blade attachment member is axially inserted into the adaptor attachment slot, wherein the coverplate member matingly engages the first face of the adaptor member, and wherein the assembled adaptor attachment member and coverplate attachment member are axially inserted into the rotor wheel attachment slot.

2. The assembly of claim 1, wherein the coverplate member further includes a panel extending radially outward relative to the hook-shaped feature, and wherein, when assembled, the panel maintains the blade attachment member axially within the adaptor attachment slot.

3. The assembly of claim 2, wherein the adaptor member further comprises a chamfer on the first face between the adaptor attachment member and the adaptor attachment slot, and wherein the coverplate member further comprises a chamfer on a mating face of the coverplate member, disposed between the hook-shaped feature and the panel, for engaging the chamfer on the first face of the adaptor member.

4. The assembly of claim 2, wherein the coverplate member provides a seal over the assembly.

5. The assembly of claim 1, wherein the blade attachment member includes a single tang dovetail configuration.

6. The assembly of claim 5, wherein a shape of the rotor wheel attachment slot and a shape of the blade attachment member are not complementary with one another.

7. The assembly of claim 6, wherein the rotor wheel attachment slot includes one of:

a two-tang configuration;

a three-tang configuration; or a T-slot configuration.

8. The assembly of claim 1, wherein the coverplate member comprises a metal alloy and the rotor wheel comprises a metal.

9. The assembly of claim 1, wherein the blade comprises one of:

a non-metallic material, selected from the group consisting of a ceramic and a ceramic matrix composite (CMC); or a metal alloy.

10. The assembly of claim 1, wherein the hook-shaped feature circumferentially and radially retains the adaptor member relative to the coverplate member.

11. A turbomachine comprising:

a rotor rotatably mounted within a stator, the rotor including:

a shaft; and at least one rotor wheel mounted on the shaft, each of the at least one rotor wheels including a rotor wheel attachment slot;

a blade having a blade attachment member, the blade attachment member including a shape that is not complementary to a shape of the rotor wheel attachment slot of each of the at least one rotor wheel; and an assembly for affixing the blade attachment member of the blade to the rotor wheel attachment slot of each of the at least one rotor wheel, the assembly including:

an adaptor member disposed between the blade and the rotor wheel, the adaptor member including:

a first face;

a second face positioned opposite the first face;

an adaptor attachment slot formed through the first face and extending toward the second face, the adaptor attachment slot complementary to the blade attachment member;

a wall formed on the second face such that the adaptor attachment slot is open on the first face only; and an adaptor attachment member that is complementary to the rotor wheel attachment slot; and a coverplate member, the coverplate member configured to engage the adaptor member and including:

a coverplate attachment member that is complementary to the rotor wheel attachment slot; and a hook-shaped feature disposed on a radially inward end of the coverplate attachment member for engaging the adaptor member, wherein the hook-shaped feature axially retains the adaptor member relative to the coverplate member, wherein the blade attachment member is axially inserted into the adaptor attachment slot, wherein the coverplate member matingly engages the first face of the adaptor member, and wherein the assembled adaptor attachment member and coverplate attachment member are axially inserted into the rotor wheel attachment slot.

12. The turbomachine of claim 11, wherein the adaptor member further comprises a chamfer on the first face between the adaptor attachment member and the adaptor attachment slot, and wherein the coverplate member further comprises a chamfer on a mating face of the coverplate member for engaging with the chamfer on the first face of the adaptor member, and a panel extending radially outward from the chamfer on the coverplate member for maintaining the blade attachment member axially within the adaptor attachment slot.

13. The turbomachine of claim 12, wherein the coverplate member provides a seal over the assembly.

14. The turbomachine of claim 11, wherein the blade attachment member includes a single tang dovetail configuration.

15. The turbomachine of claim 14, wherein a shape of the rotor wheel attachment slot and a shape of the blade attachment member are not complementary with one another, and wherein the rotor wheel attachment slot includes one of:

a two-tang configuration;

a three-tang configuration; or a T-slot configuration.

16. The turbomachine of claim 11, wherein the coverplate member comprises a metal alloy and the rotor wheel comprises a metal.

17. The turbomachine of claim 11, wherein the blade comprises one of:

a non-metallic material selected from the group consisting of a ceramic and a ceramic matrix composite (CMC), or a metal alloy.

18. The turbomachine of claim 11, wherein the hook-shaped feature circumferentially and radially retains the adaptor member relative to the coverplate member.

19. An assembly for affixing a blade having a blade attachment member to a rotor wheel having a rotor wheel attachment slot, the assembly comprising:

an adaptor member disposed between the blade and the rotor wheel, the adaptor member including:

a first face;

a second face positioned opposite the first face;

an adaptor attachment slot formed through the first face and extending toward the second face, the adaptor attachment slot complementary to the blade attachment member;

a wall formed on the second face such that the adaptor attachment slot is open on the first face only; and an adaptor attachment member that is complementary to the rotor wheel attachment slot; and a coverplate member, the coverplate member configured to engage the adaptor member and including:

a coverplate attachment member that is complementary to the rotor wheel attachment slot, wherein the blade attachment member is axially inserted into the adaptor attachment slot, and wherein the coverplate member matingly engages the first face of the adaptor member.

* * * * *